US005784789A

United States Patent [19]

Vargas

[11] Patent Number: 5,784,789

[45] Date of Patent: Jul. 28, 1998

[54] ROTARY TRIM SAW

[76] Inventor: Joseph J. Vargas, 10390 Clayton Rd., San Jose, Calif. 95127

[21] Appl. No.: 715,443

[22] Filed: Sep. 18, 1996

[51] Int. Cl.[6] ..... B27B 9/04

[52] U.S. Cl. ..... 30/388; 30/276; 30/373; 409/182

[58] Field of Search ..... 30/276, 373, 388; 409/182, 210; 144/136.95; 125/13.01; 451/358, 454

[56] References Cited

U.S. PATENT DOCUMENTS

| | | | |
|---|---|---|---|
| 1,378,258 | 5/1921 | Manderfield | 30/276 |
| 2,248,694 | 7/1941 | Boyette | 30/373 |
| 2,532,982 | 12/1950 | De Young | 30/276 |
| 2,610,658 | 9/1952 | Koeling | 30/373 |
| 2,705,513 | 4/1955 | Moeller | 144/136.95 |
| 3,111,969 | 11/1963 | Bivens | 30/373 |
| 3,466,973 | 9/1969 | Rees | 409/182 |
| 3,711,998 | 1/1973 | Mason | 451/363 |
| 4,239,428 | 12/1980 | Berzina | 409/182 |
| 4,275,501 | 6/1981 | Haire | 30/388 |
| 4,316,685 | 2/1982 | George | 409/182 |
| 4,319,860 | 3/1982 | Beares | 409/182 |
| 4,445,811 | 5/1984 | Sanders | 409/182 |
| 4,545,121 | 10/1985 | Armbruster et al. | 30/374 |
| 4,652,191 | 3/1987 | Bernier | 409/182 |
| 4,876,793 | 10/1989 | Quaglia | 30/122 |
| 4,972,588 | 11/1990 | Briach, Sr. | 30/388 |
| 4,972,589 | 11/1990 | Povleski | 30/500 |
| 4,979,307 | 12/1990 | Ste. Marie | 30/388 |
| 5,056,268 | 10/1991 | Wolff | 451/357 |
| 5,339,571 | 8/1994 | Timmons et al. | 451/342 |
| 5,339,572 | 8/1994 | Eicher | 451/358 |
| 5,430,944 | 7/1995 | Shilling | 30/388 |
| 5,439,413 | 8/1995 | Lägler | 451/353 |

OTHER PUBLICATIONS

Crain Cutter Co., Inc.; "Instruction Manual for Crain #785 Toe-Kick Saw"; Operating Instructions, Sep., 1995.

Crain Cutter Co., Inc.; "Instruction Manual for Crain #800 Super Saw"; Operating Instructions.

*Primary Examiner*—Hwei-Siu Payer

*Attorney, Agent, or Firm*—D'Alessandro & Ritchie

[57] ABSTRACT

According to the present invention, a rotary trim saw includes a rotary drive shaft coupled to a source of rotary power, while a sleeve is disposed about the drive shaft. The drive shaft is arranged for rotation relative to the sleeve. Also, a rack is disposed on an outer surface of the sleeve and parallel to the drive shaft, and a circular cutting blade is disposed at an end of the drive shaft. A base is attached and has a pinion for engaging the rack and an adjustment knob coupled to the pinion for controlling the position of the blade relative to the base.

The rotary trim saw may also have a base having surface engaging wheels attached to the base such as ball bearings although other types of wheels would also suffice such as coaster wheels. The base may also include a set screw for locking the base to the sleeve, so as to lock the cutting blade relative to the base or may also include a level attached to aid in determining a cutting angle. Retractable safety shields may also be attached to the base. The shields extend outwardly from the base so as to shield the cutting blade when not being used to cut. In addition, the base may further include an adjustable element for tilting the base so as to set a cutting angle relative to a surface on which the base is disposed. The rotary trim saw may also include a toe-kick attachment having a safety cover for making vertical plunge cuts, the cover removably connecting in two positions to the sleeve and having a locking screw.

26 Claims, 9 Drawing Sheets

ROTARY TRIM SAW

BACKGROUND OF THE INVENTION

1. Field of the Invention

The present invention relates to rotary powered saws. More particularly, this invention relates to a rotary trim saw for cutting floor materials such as underlayment and for undercutting material along walls, doors, and door jams or casings.

2. The Prior Art

General purpose power saws for use in the carpentry field are well known, i.e, rotary saws such as circular saws, SKIL saws, reciprocating saws such as jig-saws, SAWZALLS, and the like. However, there are many applications where such saws are ill-suited. For example, during construction of a new house, base boards, door casings, and doors are generally installed before the installation of a floor. This results in the additional step of trimming or undercutting most of the previously installed base boards, door casings, and doors because trimming or undercutting enables the floor boards to fit flush beneath the trim or doors. However, the trimming or undercutting step is a time consuming and laborious task since care must be taken to ensure a consistent and accurate cut of the trim pieces. Also, there are many discontinuous surfaces that require separate set-up and measurement. Some surfaces are usually located in tight places that require extra attention during trimming due to a lack of maneuvering room such as between a door casing and a wall.

Another example where conventional power saws are ill-suited is in the removal of previously installed base wall covering such as coving, especially where the coving includes an underlying cove piece filling a channel formed from the floor surface. Removing the cove piece is a difficult task and generally results in only removing the top-half of the coving at its radius since the circular trim saws currently available cannot be lowered to cut below a minimum vertical space above a floor. The current minimum vertical space is at or above about an eighth of an inch. Consequently, when removing coving, a lip is left behind along the radius of the coving and the underlying cove piece. This results in a requirement to remove the remaining lower radius or underlying cove piece.

Currently available in the art is a trim saw designed for cutting base coverings, casings, and doors and providing for a vertically adjustable circular cutting blade. The trim saw, having model number "800 Super Saw", is currently available from Crain Cutter Co., Incorporated of Milpitas, Calif. The vertical adjustment of the cutting blade is achieved through three wing nuts attached to bolts which permit the entire motor housing and the rotatably attached blade to move vertically along three slots formed along a base. The base provides smooth approximately flat skid surfaces for slidably moving the entire saw along a surface such as a floor.

This approach provides a vertical blade height adjustment only and does not allow for adjustment of the blade's cutting angle, i.e., the blade may only cut approximately parallel to the supporting surface upon which the base's flat skid surface rests and cannot operate the cutting blade at or beyond the plane of the supporting surface. Thus, while suited for its intended purposes, this trim saw is ill-suited for many trimming operations such as where cove covering must be removed without leaving the lower radius behind or where the underlying cove piece needs to be removed, as described above.

Using flat surfaces as skids also requires a great deal of user attention when ensuring a consistent and accurate trim cut especially when cutting long pieces of trim or where the supporting surface is rough and uneven. In addition, the use of a mechanism that includes a number of separate adjusting wing nuts and bolts does not lend itself to ease of adjustment of the cutting blade's cutting height. Such an adjustment scheme is a time disadvantage when encountering different trim heights since the saw rides freely along the base slots and requires the loosening and tightening of all of the wing nuts each time the blade height is adjusted. Also, the mounting of the blade along the same axis of the saw's motor and the wrap-around design of the base limits the saw's versatility for cutting trim in tight places. Lastly, the trim saw is only well-suited for one application, cutting base coverings and casings, and cannot be configured to perform other tasks, thereby requiring additional tools and expense to perform related cutting tasks in the field.

Powered saws are also used in the removal of damaged floor material such as underlayment typically found underneath counters having toe-kick spaces. A toe-kick space is found at the front bottom face of a counter and permits a user to stand closely beside the counter by providing room for the user's feet. Such saws are typically highly specialized since removal of the underlayment located within the toe-kick space requires a saw that can be maneuvered in tight places while providing a plunge cut. Thus, such highly specialized saws are usually one task tools and are not sufficiently versatile to properly handle other cutting tasks such as cutting trim pieces.

For example, as commonly known in the art, a toe-kick saw provides a hand drill driving a small diameter circular blade within a body and blade guard. The body has an approximately cylindrical shape and is attached at one end to a semicircular cutting blade shield with a portion defining a straight edge. Such prior art toe-kick saws are special purpose tools and are limited in their use to creating plunge cuts in toe-kick spaces.

OBJECTS AND ADVANTAGES OF THE INVENTION

Accordingly, it is an object of the present invention to provide a versatile power saw that may be configured to provide trim cutting or underlayment removal.

It is another object of the present invention to provide a power saw that ensures a consistent and accurate trim cut by providing a rack and pinion assembly for selectively adjusting cutting blade height and a base housing that has rotatably attached ball-shaped wheels and a swept front face to permit movement in restricted space areas.

It is another object of the present invention to provide a power saw that enables prompt and accurate configuration by providing one adjustment knob for vertical adjustment of the cutting blade height.

It is another object of the present invention to provide a power saw that enables adjustment of the cutting angle of the cutting blade, permitting the cutting blade to cut beyond the plane of the supporting surface.

It is another object of the present invention to provide a versatile trim and underlayment cutting attachment for use with the above power saw such as an angle grinder or similar powered device having a source for rotary power that may be configured to provide trim cutting or underlayment removal having the features recited above.

It is yet another object of the present invention to provide a cutting attachment with the above power saw that may be used to also remove underlayment located within a toe-kick area by providing plunge cuts.

These and many other objects and advantages of the present invention will become apparent to those of ordinary skill in the art from a consideration of the drawings and ensuing description of the invention.

SUMMARY OF THE INVENTION

In a first aspect of the invention, a rotary trim saw includes a rotary drive shaft coupled to a source of rotary power, while a sleeve is disposed about the drive shaft. The drive shaft is arranged for rotation relative to the sleeve. Also, a rack is disposed on an outer surface of the sleeve and parallel to the drive shaft, and a circular cutting blade is disposed at an end of the drive shaft. A base is attached and has a pinion for engaging the rack and an adjustment knob coupled to the pinion for controlling the position of the cutting blade relative to the base.

The rotary trim saw may also have a base having surface engaging wheels attached to the base such as ball bearings although other types of wheels would also suffice such as coaster wheels. The base may also include a set screw for locking the base to the sleeve, so as to lock the cutting blade relative to the base; or may also include a level to aid in determining a cutting angle. Retractable safety shields may also be attached to the base. The shields extend outwardly from the base so as to shield the cutting blade when not being used to cut. In addition, the base may further include an adjustable means for tilting the base so as to set a cutting angle relative to a surface on which the base is disposed.

In a second aspect of the invention, the rotary trim saw may also include a toe-kick attachment having a safety cover for making vertical plunge cuts, the cover removably connecting in two positions to the sleeve and having a locking screw.

BRIEF DESCRIPTION OF THE DRAWINGS

FIG. 8*d* is a section along line 8*d*–8*d* of FIG. 8*c*.

DESCRIPTION OF THE PREFERRED EMBODIMENTS

Those of ordinary skill in the art will realize that the following description of the present invention is illustrative only and is not intended to be in any way limiting. Other embodiments of the invention will readily suggest themselves to such skilled persons from an examination of the within disclosure.

Figure 1:
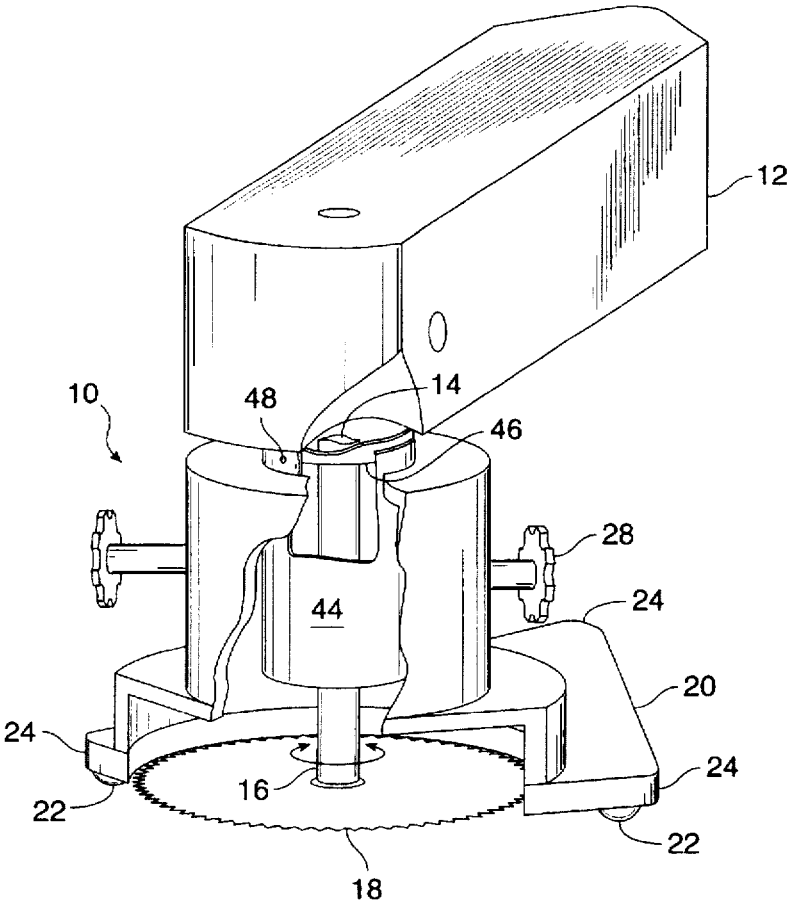
FIG. 1 is a frontal perspective diagram of a rotary trim saw according to a presently preferred embodiment of the present invention.
Figure 2A:
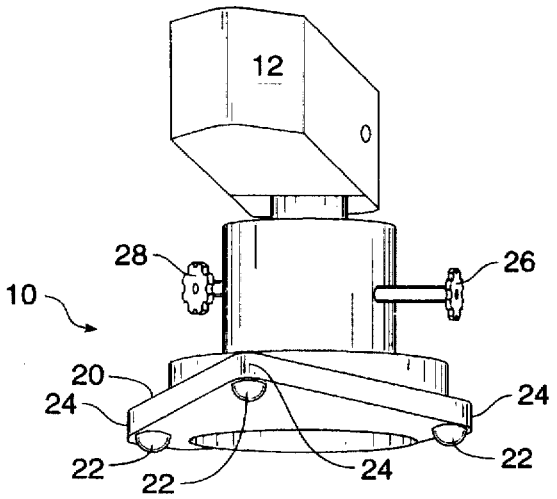
FIG. 2*a* is a rearward perspective diagram of a rotary trim saw according to a presently preferred embodiment of the present invention.
Figure 2B:
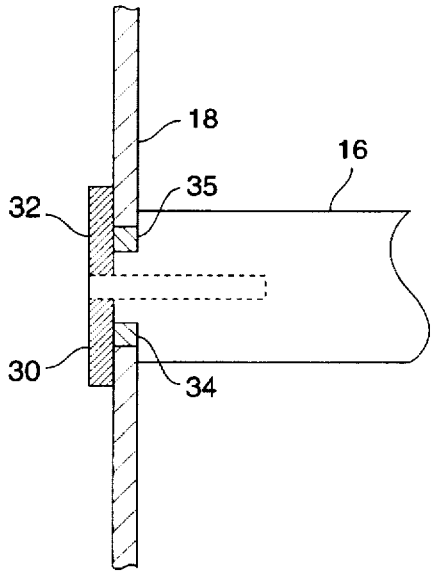
FIG. 2*b* is a partial side view diagram of the cutting blade attached to the drive shaft according to a presently preferred embodiment of the present invention.

In accordance with the presently preferred embodiment of the present invention, FIGS. 1 and 2*a*–*b* show a rotary trim saw/power saw cutting attachment 10 attached to a source of rotary power, such as a rotary motor 12. According to a presently preferred embodiment of the present invention, motor 12 is preferably a motor from an angle grinder, model "DW402 41/2", currently available from DEWALT Industrial Tool Company of Hampstead, Maryland. Similar apparatuses may also be used. The rotary trim saw 10 includes a drive shaft 14 having a blade attachment end 16 for receiving a circular cutting blade 18 and a drive end (not shown) for receiving a rotary drive (not shown) as provided by the motor 12. A removable base 20 is also shown which preferably includes means for achieving rolling movement over a surface such as a floor by means such as balls bearings 22 rotatably embedded at the corners 24 of the base 20 permitting the base to roll with 360° of movement. Surface engaging wheels or coasters may also be used in addition to or in lieu of the ball bearings. Also, the removable base preferably includes an adjustment knob 26 and a set screw 28 for adjusting and locking the cutting blade height relative to the removable base 20.

FIG. 2*b* shows the attachment of the circular cutting blade 18 to the blade attachment end 16 by use of a mounting screw 30, a washer 32, and a spacer 34. Note that in this presently preferred embodiment, the spacer 34 is used to properly center the cutting blade 18 around the circumference of tip 35 of the blade attachment end 16 although a spacer is not necessary where the cutting blade mounting hole diameter matches the diameter of tip 35.

Figure 3:
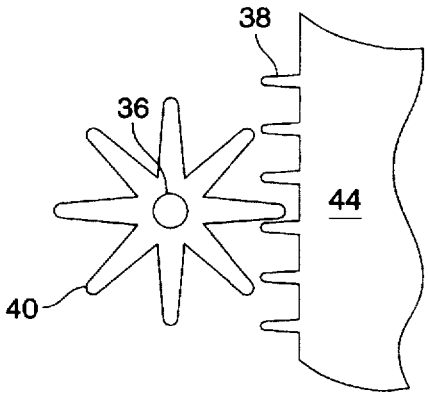
FIG. 3 is a side view of the rack and pinion mechanism for raising and lowering the cutting blade according to a presently preferred embodiment of the present invention.
Figure 4:
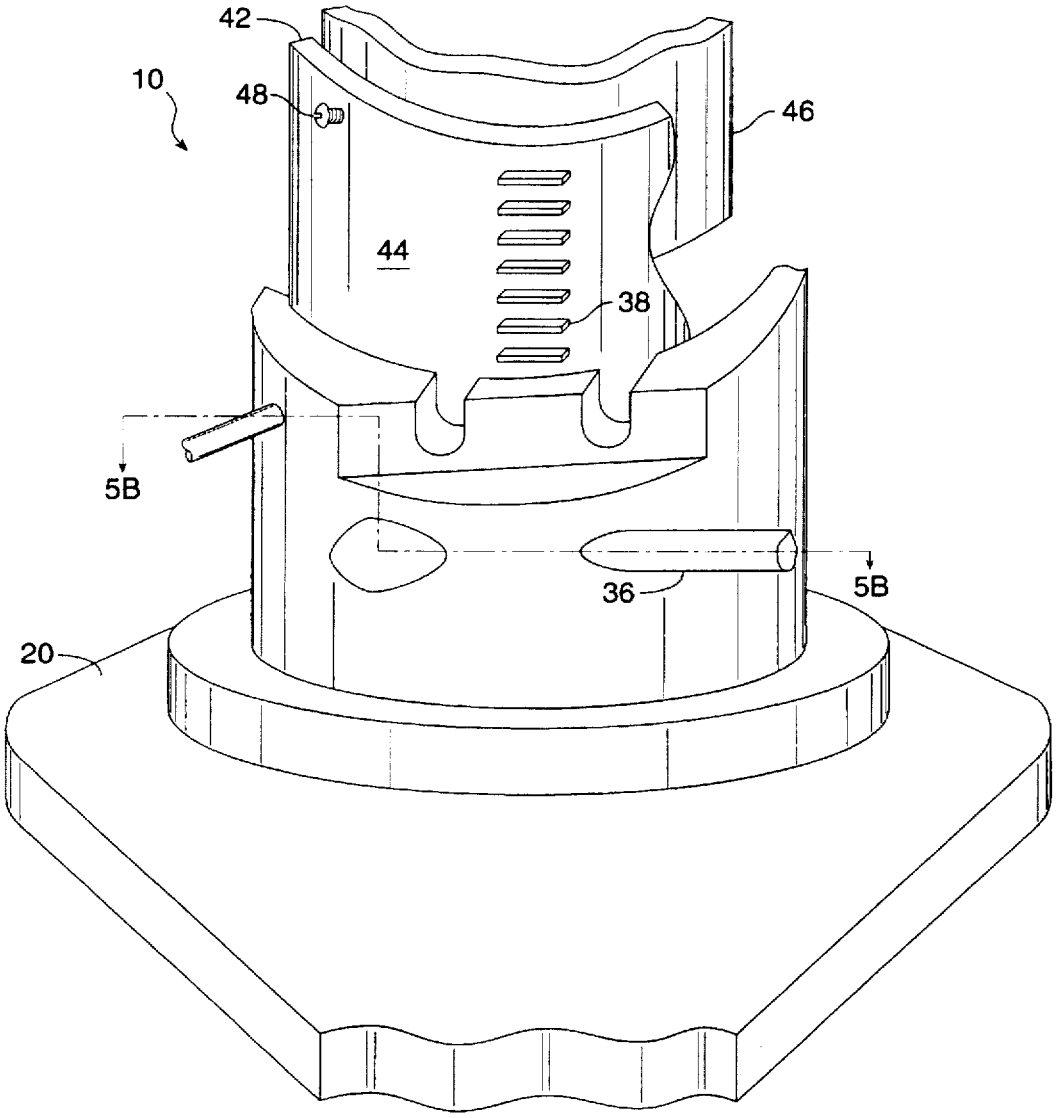
FIG. 4 is a partial perspective diagram of the present invention showing a removable base attached to a sleeve which is in turn attached to a collar of a source of rotary power according to a presently preferred embodiment of the present invention.

FIGS. 3–4 further illustrate the operation and configuration of adjustment knob shaft 36 for adjusting the cutting blade height by showing a rack 38 and a pinion 40 for raising and lowering the cutting blade 18 relative to the removable base 20. FIG. 3 is a side view of the rack 38 and pinion 40 mechanism for raising and lowering the cutting blade 18, while FIG. 4 shows the cutting attachment 10 having a cylindrical sleeve 42 with the rack 38 disposed on the outer surface 44 of the sleeve. The rack 38 is orientated parallel to the longitudinal axis of the sleeve 42, while the sleeve 42 is attached to a collar 46 provided concentrically around the drive shaft 14 of motor 12 using at least one attachment screw 48.

The integration of the rack 38 and pinion 40 to the sleeve 42 and the removable base 20 in the manner shown in FIGS. 3–4 results in an embodiment of the present invention that can receive the removable base 20 that offers both height adjustment of the cutting blade and bevel cuts extending beyond the plane of the supporting surface through a tilting mechanism and a rack and pinion mechanism; and that can also receive other attachments, such as a toe-kick attachment configured for enabling plunge cuts that can remove underlayment located within a toe-kick area. The sleeve 42 may also include a scale (not shown) on the outer surface 44 to permit a user to accurately gauge the height of the cutting blade 18 relative to a surface such as a floor upon which the removeable base 20 is engaged.

Figure 5A:
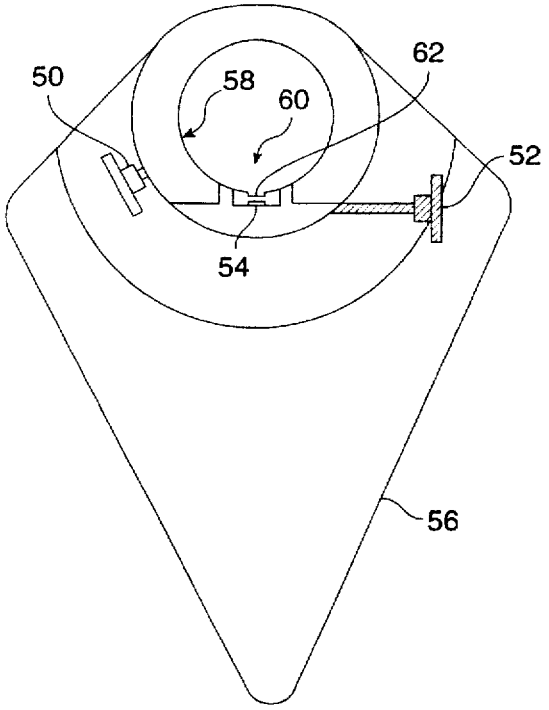
FIG. 5*a* is a top view of a removable base of a rotary trim saw according to a presently preferred embodiment of the present invention.
Figure 5B:
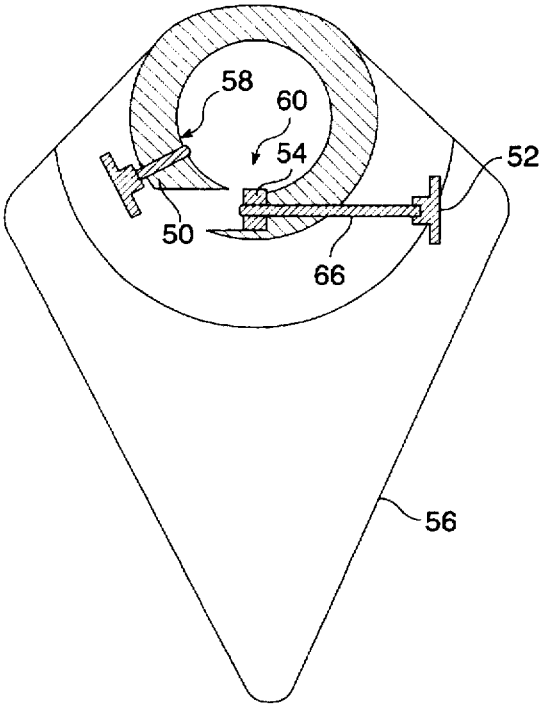
FIG. 5*b* is a top sectional view along line 5*b*–5*b* of FIG. 4 showing a pinion, adjustment knob and set screw of a rotary trim saw according to a presently preferred embodiment of the present invention.

FIGS. 5*a–b* show a top and sectional view of the removable base, respectively. FIG. 5*a* shows a set screw 50, an adjustment knob 52, and the pinion 54 installed within the removable base 56 having a shape contemplated in the preferred embodiment of the present invention. An inner edge 58 defines a circular base opening 60 for fitting around a sleeve 42 (see, FIG. 4). In addition, the circular base opening 60 contains a channel 62 of sufficient depth and width to accommodate the rack 38 disposed on sleeve 42 (see also, FIG. 4). FIG. 5*b* shows the set screw 50, the adjustment knob 52, and the pinion 54 as seen from a top sectional view taken along line 5*b* of FIG. 4. The adjustment knob 52 permits adjustment of the cutting blade height relative to the removable base 56 since the rotation of the adjustment knob 52 causes the pinion 54 to travel linearly along the rack, thereby moving sleeve 42 along the longitudinal axis of the circular base opening 60. Once a cutting blade height has been established, set screw 50 is then tightened to lock the vertical position of the cutting blade 18.

Figure 6:
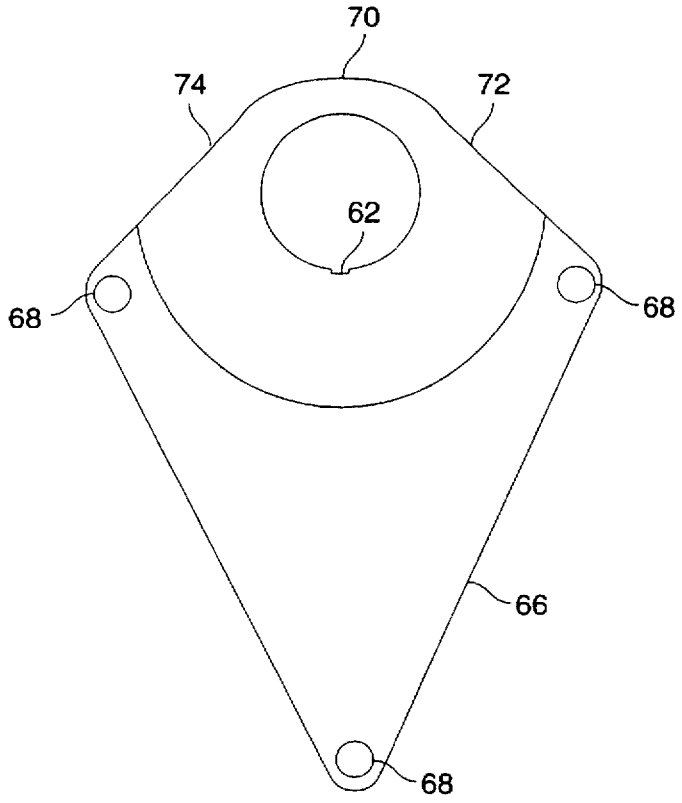
FIG. 6 is a bottom view of a removable base of a rotary trim saw according to a presently preferred embodiment of the present invention.

FIG. 6 shows a bottom view of a removable base 66 including three or more rotatably embedded ball bearings 68 and a bottom view of the channel 62 that receives the rack 38 (FIG. 4) disposed on the cylindrical sleeve 42 (FIG. 4). The front edge of base 66 has a curved front portion 70 with sides 72, 74 sweeping back to permit the cutting blade 18 (FIG. 1) to extend into tight corners that are typically encountered when trimming door casings. The shape of curved front portion 70 is not in any way intended to be limiting, but is shown to illustrate one presently preferred embodiment of the present invention.

Figure 7A:
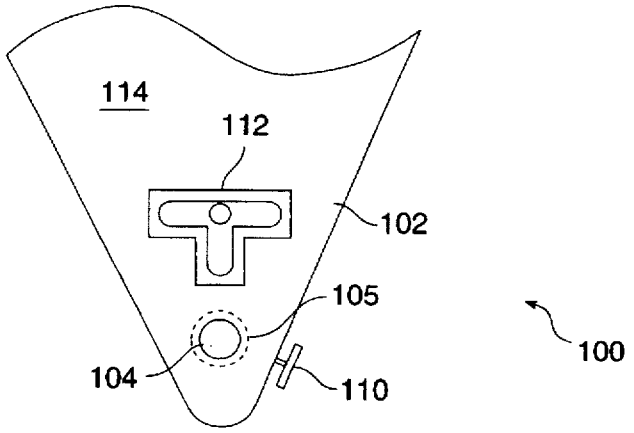
FIG. 7*a* is a top view of a removable base for a rotary trim saw having a tilting mechanism for adjusting the cutting angle of a circular blade relative to a surface supporting the removable base in accordance with a presently preferred embodiment of the present invention.
Figure 7B:
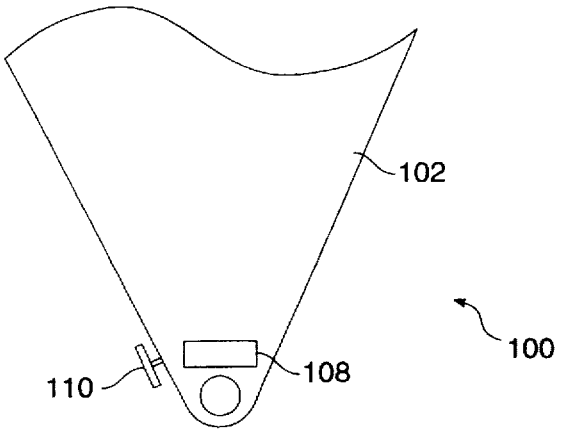
FIG. 7*b* is a bottom view of a removable base for a rotary trim saw having the tilting mechanism as shown in FIG. 7*a*.
Figure 7C:
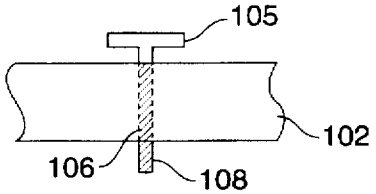
FIG. 7*c* is a side view of a removable base for a rotary trim saw having the tilting mechanism as shown in FIGS. 7*a* and 7*b*.
Figure 8A:
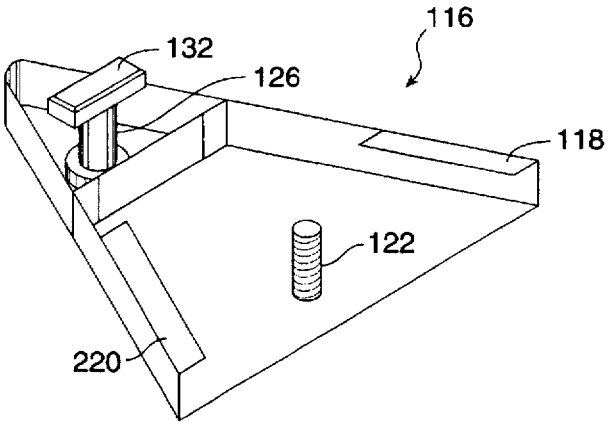
FIGS. 8*a*–*d* depict an alternative preferred embodiment of the tilting mechanism of FIGS. 7*a* and 7*b* that is in the form of a removable attachment to a removable base.
Figure 8B:
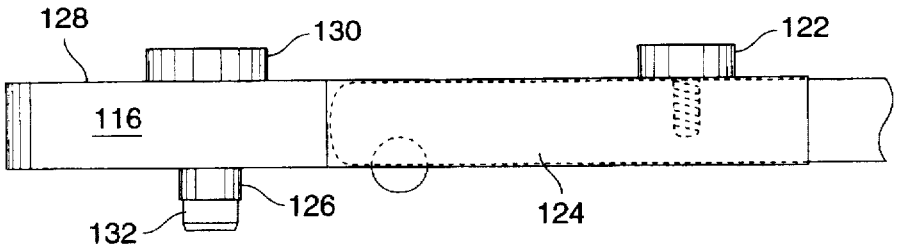
Figure 8C:
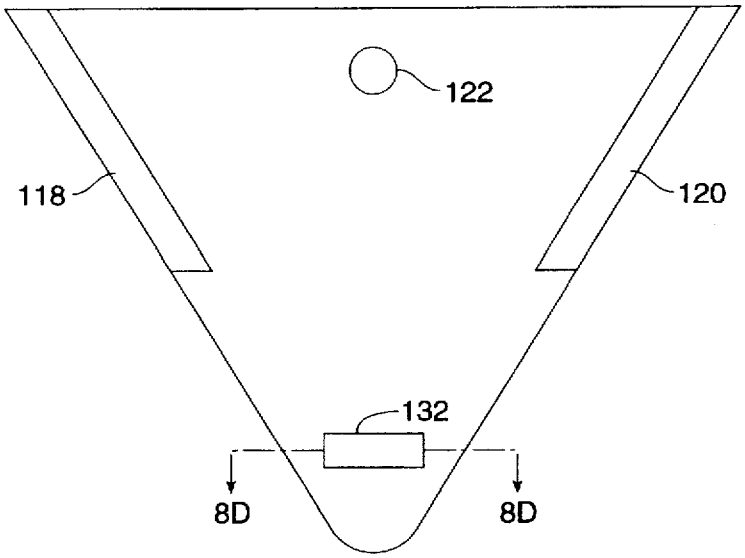
Figure 8D:
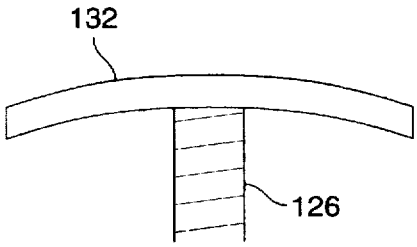

FIGS. 7*a–c* show a presently preferred embodiment of a tilting mechanism 100 for adjusting the cutting angle of cutting blade 18 relative to a supporting surface. It comprises an internally threaded hole 104 within the tail portion 102 of the removable base that receives an angle adjustment knob 105 having an externally threaded shaft 106 for adjusting the cutting angle relative to a supporting surface. The threaded shaft 106 has one end rotatably connecting to a curved end skid plate 108. A set screw 110 provides for locking the tilting mechanism. When adjusted properly, the tilting mechanism 100 can position the power saw having the removable base 20 to provide a bevel edge cut that extends beyond the plane of a supporting surface. This feature overcomes the limitation of other saws since such saws only provide a vertical adjustment of the cutting blade 18 and cannot extend the cutting blade beyond a minimum threshold above the supporting surface. Consequently, the present invention's capability to provide bevel cuts through the tilting mechanism 100 greatly lends to its versatility as a trim saw and is well-suited not only for cutting doors, doors casings, and baseboards, but is also well-suited for removing vertical surfaces such as those found on a countertop or for removing cove material at or below the plane of a supporting surface.

Note that in accordance with another preferred embodiment of the present invention, the removable base 20 may also have a "T"-shaped bubble level 112 or similar device disposed on its top surface 114 as shown in FIG. 7*a* to aid in adjusting the cutting angle of the saw.

FIGS. 8*a–d* show another preferred embodiment of a tilting mechanism 116 that is removable. It has a pair of channels 118, 120 and an attachment screw 122 which operate to fixedly connect the tilting mechanism 116 to the tail portion 124 of the removable base. In addition, a threaded adjustment shaft 126 is rotatably connected to the top surface 128 of the removable tilting mechanism 116 via an internally threaded opening (not shown). The threaded adjustment shaft 126 has one end fixedly connected to an adjustment knob 130 and the opposite end connected to a curved skid plate 132. The removable tilting mechanism 116 provides the same capability for angled or bevel cuts as described in the tilting mechanism embodiment 100 shown in FIG. 7*a* but can be removed or installed depending on the job at hand.

Note that other means such as a rotatably mounted ball or other sliding, rolling, or slipping mechanism for engaging a surface such as a floor may be substituted in lieu of the curved skid plate 132. Also, the removable tilting mechanism 116 may also include a bubble level (not shown) as described in the previous embodiment to aid in adjusting the cutting angle of the saw.

Figure 9A:
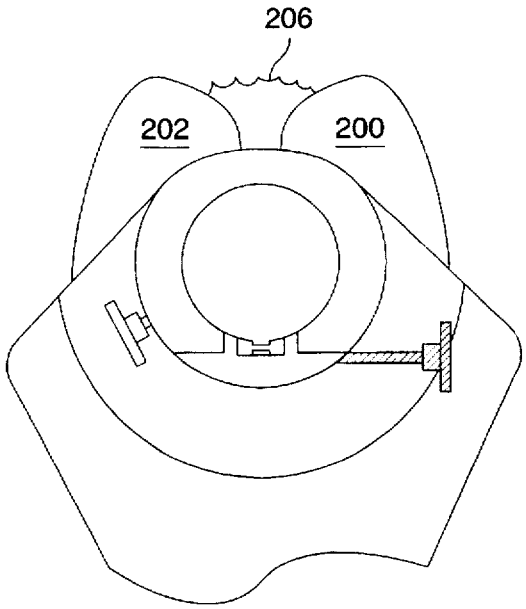
FIGS. 9*a*–9*c* show a presently preferred embodiment of a safety shield for use with the circular blade of the rotary trim saw.
Figure 9B:
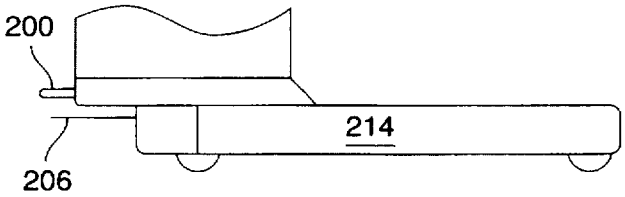
Figure 9C:
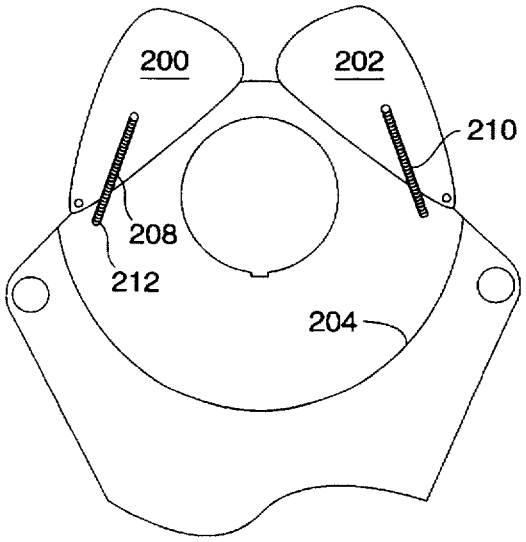

FIGS. 9*a–c* show another embodiment of the present invention having a pair of retracting safety shields 200, 202. The shields 200, 202 are disposed within a base cavity 204 and are biased to extend beyond the cutting blade edge 206. In one embodiment of the present invention, biasing is accomplished by using coiled springs 208, 210 each having one end connected to the roof 212 of the base cavity 204 and the other end connected to one of the retractable shield pairs 200, 202. The safety shields 200, 202 retract when the removable base 214 is pushed against a surface, forcibly retracting the safety shields 200, 202 within the base cavity 204 and exposing the edge 206 of the cutting blade.

Figure 10A:
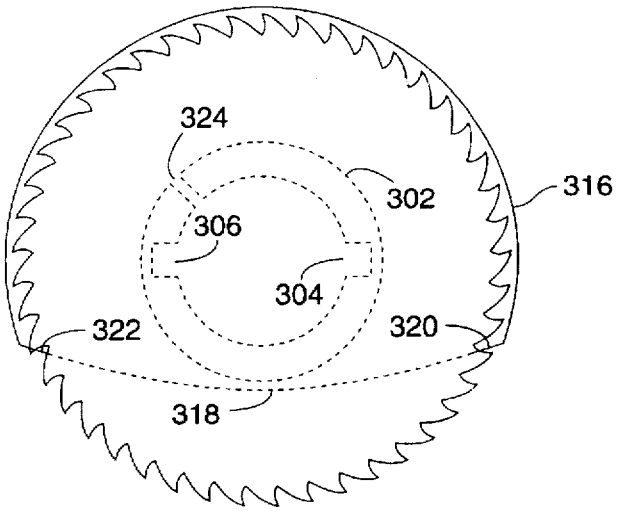
FIGS. 10*a*–*b* show a presently preferred embodiment of the toe-kick attachment for use with the rotary trim saw of the present invention.
Figure 10B:
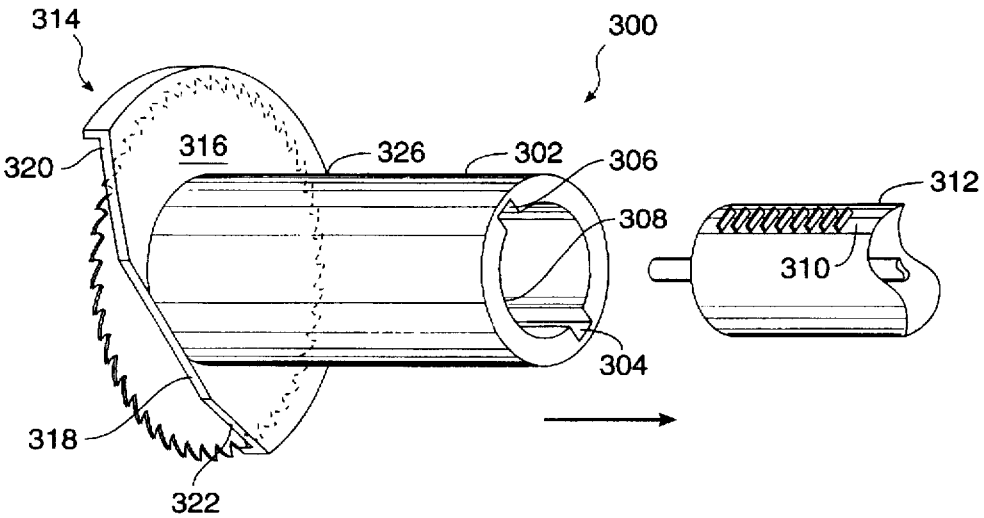

FIGS. 10*a–b* show another embodiment of the present invention having a toe-kick or plunge-cut attachment 300. In the preferred embodiment, the attachment 300 has an elongated body 302 having two oppositely disposed channels 304, 306 along its inner wall 308 that are positioned to accommodate the rack 310 disposed on the sleeve 312. The body 302 may be any shape that fits around the sleeve 312 that is attached to a motor means and is shown having an annular shape in FIGS. 10*a–b* but may be any shape that fits around the sleeve used. The oppositely disposed channels 304, 306 results in a two-position toe-kick attachment since the two channels 304, 306 permit the attachment 300 to be rotated 180°, thereby facilitating left-handed or right-handed operation when the attachment 300 is used with a motor means such as a motor used in an angle grinder.

Also, FIGS. 10*a–b* also show the tow-kick attachment 300 having a blade cover 314 that includes a portion that operates as a safety shield 316 and a portion that operates as a cutting depth limiter 318. The cutting depth limiter 318 has a pair of angled portions 320, 322 to facilitate entry of the cutting blade into the surface intended to be cut. The angle of angled portions 320, 322 are not intended in anyway to be limiting but are shown simply to illustrate one embodiment of the present invention. FIGS. 10*a–b* also show an internally threaded aperture 324 on the elongated body 302 of the toe-kick attachment 300 that operates to lock the attachment 300 on to the sleeve 312 attached to the motor means using an externally threaded set screw 326.

While illustrative embodiments and applications of this invention have been shown and described, it would be apparent to those skilled in the art that many more modifications than have been mentioned above are possible without departing from the inventive concepts set forth herein. The invention, therefore, is not to be limited except in the spirit of the appended claims.

What is claimed is:

1. A rotary trim saw for attachment to a source of rotary power, the rotary trim saw comprising:

a sleeve attached to a housing for holding the source of rotary power and having a rack disposed on an outer surface of said sleeve and approximately longitudinally parallel to an axis of said sleeve;

a drive shaft having a blade attachment end attached to a circular cutting blade and a drive end coupled to the source of rotary power, said rotatable drive shaft disposed within said sleeve and approximately longitudinally parallel to said axis of said sleeve;

a removable base having a rotatable attached pinion for engaging said rack and a base opening defined by an inner edge for fitting around said sleeve; and a position of said cutting blade relative to said base adjustable along said axis of said sleeve in response to rotation of an adjustment knob attached to said pinion.

2. The rotary trim saw in claim 1, wherein said removable base further including a set screw for locking said removable base to said sleeve, so as to lock said position of said cutting blade relative to said removable base.

3. The rotary trim saw in claim 1, wherein said base further comprises means for rolling said base along a surface.

4. The rotary trim saw in claim 1, wherein said base further comprises a level attached to said base.

5. The rotary trim saw in claim 1, wherein said base further comprises means for tilting said base so as to set a cutting blade cutting angle.

6. The rotary trim saw in claim 1, wherein said base further comprises retractable safety shields.

7. The rotary trim saw in claim 1, further comprising a safety cover for making vertical plunge cuts, said cover removably connecting in two positions to said sleeve and having a locking screw.

8. A rotary trim saw, comprising:

a source of rotary power;

a rotary drive shaft coupled to said source of rotary power;

a sleeve disposed about said drive shaft, said drive shaft arranged for rotation relative to said sleeve;

a rack disposed on an outer surface of said sleeve and parallel to said drive shaft;

a circular cutting blade disposed at an end of said drive shaft;

a base having a pinion for engaging said rack; and an adjustment knob coupled to said pinion for controlling the position of said blade relative to said base.

9. A rotary trim saw according to claim 8, further comprising a plurality of surface engaging wheels attached to said base.

10. A rotary trim saw according to claim 9, wherein said surface engaging wheels are ball bearings.

11. A rotary trim saw according to claim 8, wherein said base further comprises a set screw for locking said base to said sleeve, so as to lock said blade position relative said base.

12. A rotary trim saw according to claim 8, wherein said base further comprises a level attached to said base.

13. A rotary trim saw according to claim 8, wherein said base further comprises a retractable safety shield extending outwardly from said base so as to shield said cutting blade when not being used to cut.

14. A rotary trim saw according to claim 8, wherein said base further comprises an adjustable tilting means for tilting said base so as to set a cutting blade cutting angle relative to a surface on which said base is disposed.

15. A rotary trim saw for attachment to a source of rotary power, the rotary trim saw comprising:

a non-rotating sleeve attached to a housing for holding the source of rotary power and having a rack disposed on an outer surface of said sleeve and approximately longitudinally parallel to an axis of said sleeve; and a rotatable drive shaft having a blade attachment end attached to a circular cutting blade and a drive end coupled to the source of rotary power, said rotatable drive shaft disposed within said sleeve and approximately longitudinally parallel to said axis of said sleeve.

16. A rotary trim saw comprising:

a motor having a rotary drive output;

a drive shaft having a blade attachment end for receiving a circular cutting blade and a drive end for coupling said rotary drive output;

a sleeve disposed about said drive shaft, said sleeve including a rack disposed on an outer surface of said sleeve and parallel to a longitudinal axis of said sleeve;

a base having a pinion for engaging said rack using an adjustment knob attached to said pinion for controlling the position of said blade relative to said base, a set screw for locking said base to said sleeve and fixing said position of said blade with respect to said base, a retractable safety shield, and surface engaging wheels for rolling along a surface in any direction;

a level attached to said base; and means for tilting said base so as to set a cutting blade cutting angle between said cutting blade and said surface.

17. The rotary trim saw in claim 16, wherein said motor is an angle grinder motor.

18. A rotary trim saw according to claim 16, further comprising a toe-kick attachment having a safety cover and a body, said safety cover including a cutting depth limiter having angled portions at each end, and said body for removably connecting in two positions to said sleeve and having a locking screw therethrough.

19. A rotary trim saw according to claim 16, wherein said means for tilting includes:

a platform having an attachment screw for screwing onto an internally threaded aperture at a tail portion of said base;

at least two channels for engaging onto the sides of said tail portion of said base;

an adjustment knob and an externally threaded bolt movably engaged in an internally threaded aperture disposed on said platform for varying the angle of tilt of said platform relative to a supporting surface; and a supporting plate moveably connected to the externally threaded bolt opposite of said adjustment knob for supporting said tail portion and for moveably engaging said supporting surface.

20. A rotary trim saw for attachment to a source of rotary power, the rotary trim saw comprising:

a sleeve having a rack disposed on an outer surface of said sleeve and longitudinally parallel to the axis of said sleeve, said sleeve attached to a housing containing the source of rotary power;

a rotatable drive shaft having a blade attachment end attached to a circular cutting blade and a drive end coupled to the source of rotary power;

a removable base having a pinion for engaging said rack and a base opening slidably attached to said outer surface of said sleeve; and a position of said cutting blade relative to said base adjustable in response to rotation of an adjustment knob attached to said pinion.

21. The rotary trim saw in claim 20, wherein said base further comprises a set screw for locking said base to said sleeve, so as to lock said position of said cutting blade.

22. The rotary trim saw in claim 20, wherein said base further comprises means for rolling said base along a surface.

23. The rotary trim saw in claim 20, wherein said base further comprises a level attached to said base.

24. The rotary trim saw in claim 20, wherein said base further comprises a tilting mechanism attached to said base so as to set a cutting blade cutting angle.

25. The rotary trim saw in claim 20, wherein said base further comprises retractable safety shields.

26. The rotary trim saw in claim 20, further comprising a safety cover for making vertical plunge cuts, said safety cover removably connected in two positions to said sleeve and having a locking screw.

* * * * *